United States Patent [19]

Macias

[11] Patent Number: 4,862,654

[45] Date of Patent: Sep. 5, 1989

[54] FLOOR ALIGNING JACK

[76] Inventor: Curt B. Macias, 102 Robinson Ave., Harrisburg, N.C. 28075

[21] Appl. No.: 189,381

[22] Filed: May 2, 1988

[51] Int. Cl.[4] ..... E04H 1/00

[52] U.S. Cl. ..... 52/126.1; 52/126.5; 52/79.7

[58] Field of Search ..... 52/126.5, 126.1, 291, 52/79.6, 79.7, 79.8, 127.2, 480, 584

[56] References Cited

U.S. PATENT DOCUMENTS

| | | | |
|---|---|---|---|
| 365,427 | 6/1887 | Berge | 52/584 |
| 735,960 | 8/1903 | Gailhou | 52/480 |
| 1,604,875 | 10/1926 | Bogaty | 52/584 |
| 2,582,657 | 1/1952 | Serner | 52/584 |
| 2,982,321 | 5/1961 | Hancock | 52/291 |
| 3,605,350 | 9/1971 | Bowers | 52/79.7 |
| 4,105,351 | 8/1978 | Anderson | 52/584 |
| 4,388,790 | 1/1983 | Greco | 52/584 |
| 4,538,340 | 9/1985 | Ricke | 52/584 |
| 4,599,829 | 7/1986 | Di Martino | 52/79.7 |

FOREIGN PATENT DOCUMENTS

| | | | |
|---|---|---|---|
| 2820162 | 11/1978 | Fed. Rep. of Germany | 52/584 |
| 1951801 | 1/1980 | Fed. Rep. of Germany | 52/584 |

*Primary Examiner*—Henry E. Raduazo

*Attorney, Agent, or Firm*—W. Thad Adams, III

[57] ABSTRACT

A floor aligning jack for aligning higher and lower adjoining two floors of complementary halves of a structure such as a double wide mobile home. The aligning jack comprises a fastening bar for being fixedly secured to a band joist extending longitudinally along the length of the structure and to which the higher of the two floors of the complementary halves of the structure is secured. A shank is carried by the fastening bar for extending below the bottom of the band joists of both complementary structure halves and jacking means adjustably cooperate with the shank for being adjusted to engage the bottom of the band joist of the lower of the two floors. This raises and supports the lower of the two floors to the level of the higher floor.

8 Claims, 3 Drawing Sheets

FLOOR ALIGNING JACK

TECHNICAL FIELD AND BACKGROUND OF THE INVENTION

This invention relates to a floor aligning jack and has particular utility in aligning adjoining floors of "double wide" mobile homes. It is important to note at the outset that this invention is not a floor leveling jack, nor does the invention support the overall floor structure of the mobile home. Rather, it aligns the floors of the two complementary structures at the point where the floors mate edge to edge.

Double wide mobile homes are generally constructed by prefabricating two halves which are then moved to a building site and mounted on a foundation. The two halves are mated to form a single dwelling. The two halves can be aligned and joined at walls without difficulty. Along long floor spans, however, the floors are generally ¼ to 2 inches out of alignment due to manufacturing and foundation variations, and warped or uneven wood structural members out of which the floors and joists are constructed. In prior art methods, the floors are shimmed or leveled with jacks which are placed on the ground beneath the building and which raise the lowermost of the two floors to the level of the uppermost of the two floors.

This invention permits the floors to be aligned without using ground-contacting jacks which are themselves subject to settling or shifting due to soil compaction.

SUMMARY OF THE INVENTION

Therefore, it is an object of the invention to provide a floor aligning jack which permits floors to be aligned without the use of ground-contacting jacks.

It is another object of the invention to provide a floor aligning jack which can be installed at the manufacturing plant for adjustment after the mobile home is erected on its permanent site.

It is another object of the invention to provide a floor aligning jack which is inexpensive and easy to use.

These and other objects of the present invention are achieved in the preferred embodiments disclosed below by providing a floor aligning jack for aligning higher and lower adjoining two floors of complementary halves of a structure such as a double wide mobile home. The aligning jack comprises a fastening bar fixedly secured to a band joist extending longitudinally along th length of the structure and to which the higher of the two floors of the complementary halves of the structure is secured. A shank is carried by the fastening bar for extending below the bottom of the band joists of both complementary structure halves. A jacking portion cooperates with the shank for being adjusted to engage the bottom of the band joist of the lower of the two floors. This raises and supports the lower of the two floors to the level of the higher floor.

According to one preferred embodiment of the invention, the shank comprises a threaded rod and the jacking portion comprises a support plate mounted on the threaded rod for adjustable movement in relation thereto.

According to another preferred embodiment of the invention, the jacking means includes a nut positioned on the threaded rod for supporting and locking the support plate in position.

Preferably, the jack includes a laterally-extending blade formed on the end of the fastening bar for being positioned between the floor and the band joist for providing support to the aligning jack and the lower of the two floors.

Preferably, the blade includes a hook on the free end thereof for hooking over top and opposite sides of the band joist.

According to yet another preferred embodiment of the invention, the fastening bar includes a plurality of nail holes for receiving fastening nails therethrough and into the band joist.

Preferably, the invention includes a spacing member positioned on the support plate for being positioned under the band joist of the lower floor and supporting the lower floor at a position level with the higher floor with the support plate spaced below the band joist of the higher floor.

BRIEF DESCRIPTION OF THE DRAWINGS

Some of the objects of the invention have been set forth above. Other objects and advantages of the invention will appear as the description of the invention proceeds when taken in conjunction with the following drawings, in which.

DESCRIPTION OF THE PREFERRED EMBODIMENT

Figure 1:
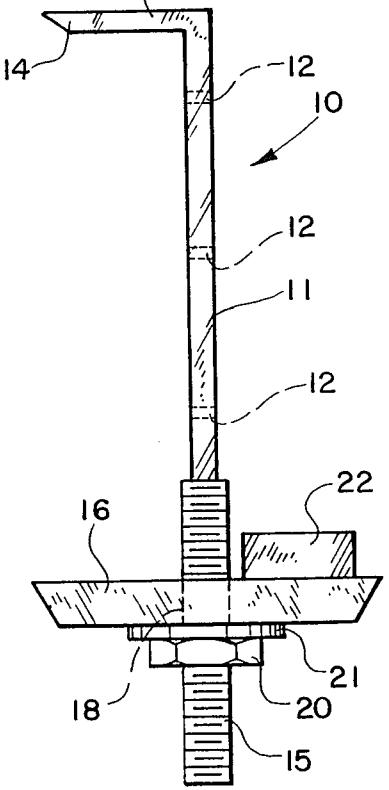
FIG. 1 is a side elevation view of one embodiment of the invention.
Figure 2:
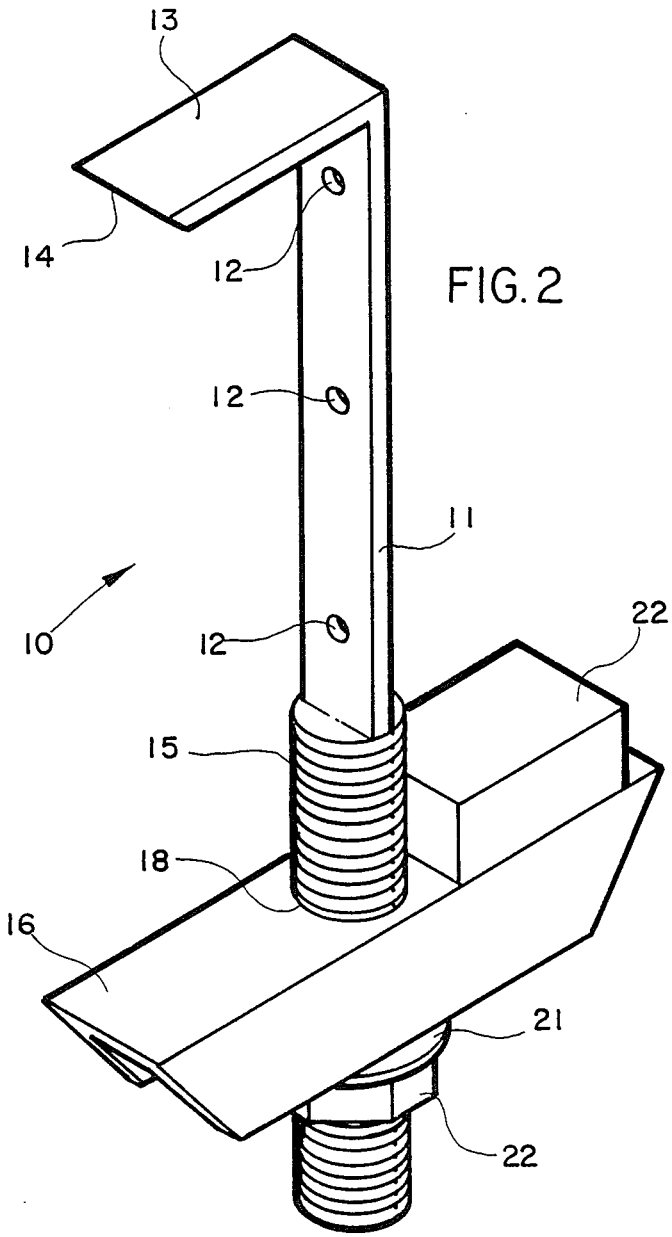
FIG. 2 is a perspective view of the embodiment shown in FIG. 1.

Referring now specifically to the drawings, a floor aligning jack according to the present invention is illustrated in FIGS. 1 and 2 and shown generally at reference numeral 10.

In the description below, reference will be made to the floors and band joists of two complementary halves of a structure such as a double wide mobile home. Reference to the "higher" and "lower" of the two floors and band joists in the Specification and the Claims refers to the misaligned position of the floors and the band joists before the jack 10 has been used to align the floors in accordance with the invention.

Jack 10 is constructed of a flat steel fastening bar 11 having several spaced-apart nail holes 12. The top of fastening bar 11 is bent at right angles to define a blade 13. The free end 14 of blade 13 is tapered and enables the blade to be driven between a floor and band joist.

A threaded shank 15 is fixedly secured, for example, by welding to the other end of fastening bar 11. Preferably, a 1"–1½" notch in the shank 15 receives fastening bar 11 which is then welded in place. A support plate 16, constructed of a heavy duty length of channel steel, is mounted on shank 15 through a centrally-disposed hole 18. Hole 18 is not threaded, and is slightly oversized in relation to the threaded shank 15 so that support plate 16 will move up and down on shank 15 without significant axial deflection. Support plate 16 is moved up and down shank 15 and locked into a desired position by means of a threaded nut 20 and oversized washer 21.

A spacing member 22, comprising a steel block, is secured as by welding to the top of one side of support plate 16 and is placed under the band joist of the lower of the two floors, as described below.

Figure 4:
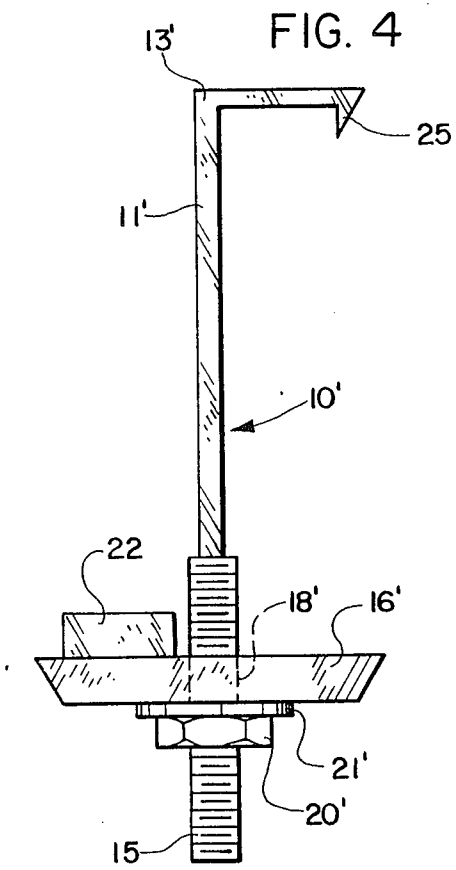
FIG. 4 is a side elevation view of an alternate embodiment of the invention.

An alternate embodiment of a jack according to the present invention is shown in FIG. 4 and broadly identified at reference numeral 10', with the like elements indicated by prime notation. Blade 13' of jack 10' includes a hook 25, which permits the fastening bar 11' to be installed at the manufacturing plant before the floor is applied over the band joist. The floor, when installed, holds the fastening bar 11' in place. Nails may also be used, if desired.

Figure 3:
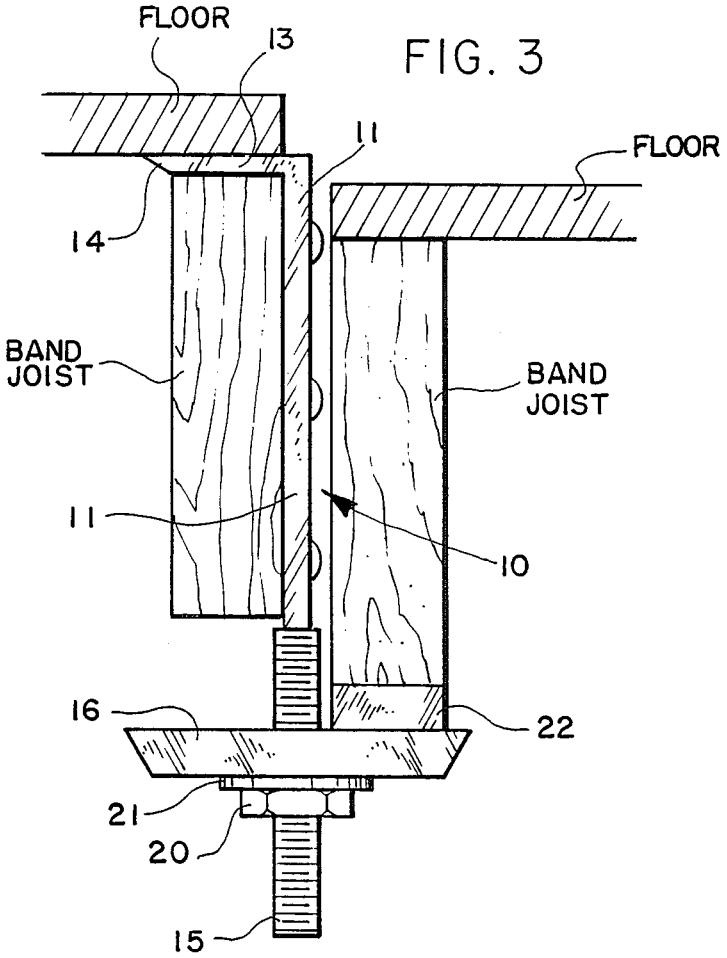
FIG. 3 is a side elevation view showing the jack in position between two complementary floor halves, with dimensions exaggerated for purposes of illustration.

Referring now to FIG. 3, use of jack 10 is illustrated. The dimensions have been exaggerated for purposes of explanation. In practice, the fastening are 11 is sufficiently thin so that no appreciable space between the two floor halves exits. As is shown in FIG. 3, jack 10 is positioned in fixed relation to the higher of the two floors. Spacing member 22 is positioned under the lower band joist and a wrench is used to turn nut 20 upwardly, thereby jacking the lower band joist and floor upwardly into alignment with the higher floor. Then, if desired, the two band joists are nailed together to hold them in alignment.

Figure 5:
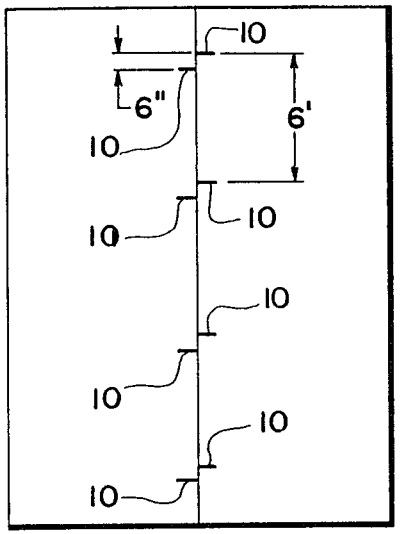
FIG. 5 is a schematic top plan view of a double wide mobile home showing a particular placement of the jacks.

Referring now to FIG. 5, the manner of use of several of the jacks 10 or 10' is explained and illustrated. As noted above, warpage and manufacturing variations cause misalignment of the floors. To correct the alignment along the entire length of the mobile home, pairs of jacks 10 are positioned on complementary band joists approximately six inches apart. These pairs of the jacks 10 are positioned about every six feet along open floor spans between walls. At each position, only the jack fixed to the higher floor and band joist is used. By using paris of these jacks 10 or 10' the floor can be aligned exactly so that the floors are flush with each other. It should be noted again that separate means must be used to level the entire structure so that the floors are perpendicular to gravitational direction. This is ordinarily done with ground supported jacks and a spirit level.

In accordance with a preferred embodiment of the invention, the jack 10 is fabricated of ⅛" thick and 1" wide strap steel having an overall length of 6". The blades 13 and 13' have an approximate length of 2" and is sized to fit over the top of a wooden structural member such as a band joist having a nominal width of somewhat less than 2".

A floor aligning jack is described above. Various details of the invention may be changed without departing from its scope. Furthermore, the foregoing description of the preferred embodiment according to the present invention is provided for the purpose of illustration only and not for the purpose of limitation--the invention being defined by the claims.

I claim:

1. A floor aligning jack for aligning higher and lower adjoining two floors of complementary halves of a structure such as a double wide mobile home, said aligning jack comprising:

(a) a fastening bar for being fixedly secured to a band joist extending longitudinally along the length of the structure and to which the higher of the two floors of the complementary halves of the structure is secured wherein said fastening bar includes at least one hole for receiving a fastening member therethrough and into the band joist for securing the fastening bar to the band joist;

(b) a shank carried by the fastening bar for extending below the bottom of the band joists of both complementary structure halves; and (c) jacking means adjustably cooperating with said shank for being adjusted to engage the bottom of the band joist of the lower of the two floors for raising and supporting the lower of the two floors to the level of the higher floor.

2. A floor aligning jack according to claim 1, wherein said shank comprises a threaded rod and wherein said jacking means comprises a support plate mounted on said threaded rod for adjustable movement in relation thereto.

3. A floor aligning jack according to claim 1, wherein said jacking means includes a nut positioned on said threaded rod for supporting and locking said support plate in position.

4. A floor aligning jack according to claim 1, and including a laterally-extending blade formed on the end of the fastening bar for being positioned between the floor and the band joist for providing support to the aligning jack and the lower of the two floors.

5. A floor aligning jack according to claim 4, wherein said blade includes a hook on the free end thereof for hooking over top and opposite sides of the band joist.

6. A floor aligning jack according to claim 2, and including a spacing member positioned on said support plate for being positioned under the band joist of the lower floor and supporting said lower floor at a position level with the higher floor with said support plate spaced below the band joist of the higher floor.

7. A floor aligning jack for aligning higher and lower adjoining two floors of complementary halves of a structure such as a double wide mobile home, said aligning jack comprising:

(a) a fastening bar with a plurality of holes therein for being fixedly secured by fastening members to a band joist extending longitudinally along the length of the structure and to which the higher of the two floors of the complementary halves of the structure is secured, said fastening bar including a laterally-extending blade formed on the end of the fastening bar for being positioned between the floor and the band joist for providing support to the aligning jack and the lower of the two floors;

(b) a threaded shank carried by the fastening bar for extending below the bottom of the band joists of both complementary structure halves;

(c) a support plate adjustably cooperating with said shank for being adjusted to engage the bottom of the band joist of the lower of the two floors for raising and supporting the lower of the two floors to the level of the higher floor; and (d) a threaded nut cooperating with said threaded shank for supporting and locking said support plate into position.

8. A floor aligning jack according to claim 7, and including a spacing member positioned on said support plate for being positioned under the band joist of the lower floor and supporting said lower floor at a position level with the higher floor with said support plate spaced below the band joist of the higher floor.

* * * * *